US006025047A

United States Patent [19]

Catta et al.

[11] Patent Number: 6,025,047

[45] Date of Patent: Feb. 15, 2000

[54] FLEXIBLE NOSING SYSTEM

[75] Inventors: David Catta; Geoffrey William Gosling, both of Calgary, Canada

[73] Assignee: Evans Consoles Inc., Calgary, Canada

[21] Appl. No.: 08/950,992

[22] Filed: Oct. 15, 1997

Related U.S. Application Data

[63] Continuation of application No. 08/515,266, Aug. 15, 1995, abandoned.

[51] Int. Cl.[7] ..... B32B 3/06

[52] U.S. Cl. ..... 428/99; 428/122; 428/192; 248/345.1; 108/27; 312/137

[58] Field of Search ..... 428/99, 100, 122, 428/192; 248/345.1; 108/27; 52/800.11, 717.03, 717.04, 717.05; 312/137

[56] References Cited

U.S. PATENT DOCUMENTS

| | | | |
|---|---|---|---|
| 4,858,413 | 8/1989 | Grushka | 108/27 |
| 5,283,096 | 2/1994 | Greenberg et al. | 428/99 |
| 5,618,593 | 4/1997 | Belser | 428/31 |

FOREIGN PATENT DOCUMENTS 761150 6/1967 Canada .

*Primary Examiner*—Alexander Thomas
*Attorney, Agent, or Firm*—Notaro & Michalos P.C.

[57] ABSTRACT

There is described a method and a system for edging a core, comprising a carrier adapted for connection to a contiguous edge of a core, a surface casing adapted for a conformable fit over the carrier and means for connecting the surface casing to the carrier for a conformable fit therebetween.

26 Claims, 3 Drawing Sheets

FLEXIBLE NOSING SYSTEM

This application is a continuation of application Ser. No. 08/515,266, filed Aug. 15, 1995 now abandoned.

FIELD OF THE INVENTION

The present invention relates to a finishing piece and more particularly to an edging or nosing system to provide a finished edge to a work surface.

BACKGROUND OF THE INVENTION

Manufacturers of work stations and consoles of the sort used in computer operation facilities work to a large extent in a custom or semi-custom furniture environment where the design and style of their products changes from project to project. As well, equipment consoles, work stations and the like include work surfaces designed paying particular additional concern to the ergonomic requirements of their users. As a result, these work surfaces will also change from one customer to another. The ergonomic considerations require that the edges of the work surfaces be properly contoured and finished. Particularly in higher end products, aesthetics are also an important consideration.

Custom work tends to be expensive and the more so the greater number of parts unique to the job at hand. Accordingly, adaptability of a custom edging system for different work surface configurations and designs significantly reduces costs in terms of both part fabrication and work surface assembly. Parts inventories can be reduced and economies of scale resulting from a longer production run for a single configuration are attained.

Known edging techniques include "casting" of edge materials, using polymers, onto the work surface core. This method is used primarily for production of relatively small work pieces and requires a mould, itself a specialized tooling, which encapsulates the entire work piece. Another method makes use of an extruded rigid or semi-rigid spine and a softer covering material. Existing co-extruded edges of this sort however are not conformable to curved core edges, do not allow for larger protrusions from the work surface core and generally lack the refinements needed to effectively hold the outer moulded or extruded skin in place in complete contact with the spine.

The lack of larger edge sections from this known method is particularly disadvantageous. Beyond a certain size, these pieces simply lack the strength necessary to provide commercial durability. People leaning on the edges, impacts from chairs and carts and ordinary wear and tear in the working environment simply break these treatments down.

Another known technique is the installation of a rubber or rubberized skin (e.g. PVC cushion) onto a wood spine. This is relatively efficient but only for those fabricators who know what they will be making tomorrow. This technique allows little or no flexibility of layout or shape and for those therefore in the semi-custom environment, this is not an economic alternative.

And yet in work surface design, a finished, padded gentle "waterfall" edge is generally recognized as ergonomically important. Such edge or nosing treatments provide a gentle transition between the user's limbs and the horizontal work surface. The feel is important as well, particularly the temperature feel of the edge in contact with the user's limbs. Traditional plastic laminates are cold and don't provide the "warmth" of self-skinning polyurethane. Plastic laminates will also chip and crack from chair and cart impacts whereas padded edge systems are bump and impact absorbent.

SUMMARY OF THE INVENTION

The problem therefore is to provide an ergonomic nosing system adaptable to a variety of work surface shapes and sizes at a reasonable cost. The applicant has addressed these problems by providing a nosing system having a structurally strong flexible core or carrier and a separate resilient surface treatment.

It is an object therefore of the present invention to provide a nosing system that obviates and mitigates from the disadvantages of the prior art.

It is a further object of the present invention to provide a nosing system which is both very strong and durable and yet is adapted for use in relation to a variety of work surface configurations.

In a preferred embodiment, the present invention can achieve both small and large bending radii in either the convex or concave direction.

According to the present invention then, there is provided a system for edging a core, comprising carrier means adapted for connection to a contiguous edge of the core, surface casing means adapted for a conformable fit over the carrier means, and means for connecting the surface casing to the carrier means for a conformable fit therebetween.

BRIEF DESCRIPTION OF THE DRAWINGS

Preferred embodiments of the present invention will now be described in greater detail, and will be better understood when read in conjunction with the following drawings, in which.

DETAILED DESCRIPTION

Figure 1:
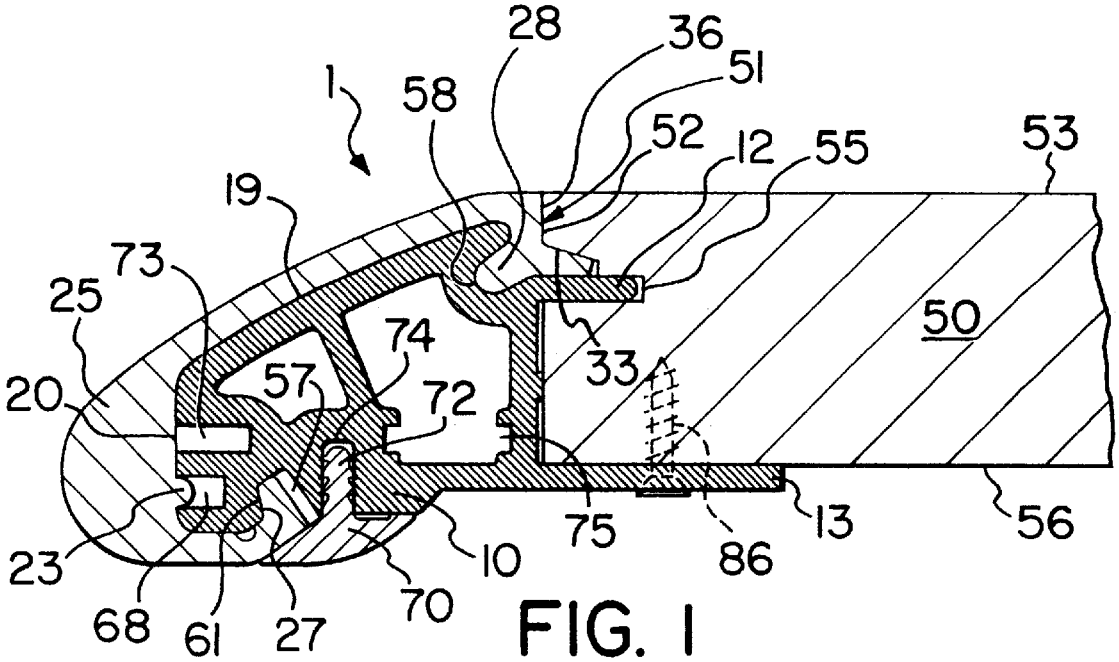
FIG. 1 is a side elevational sectional view of the present nosing system.

With reference initially to FIG. 1, the present nosing system 1 generally comprises a carrier 10, typically an aluminum extrusion, and a pliant surface casing 25 of a material such as cast urethane or extruded SANTOPRENE™ or similar flexible soft material. Carrier 10 is adapted for connection to a core 50 including a machined or routered edge 51 and a work surface 53.

Carrier 10 is formed with a pair of rearwardly extending flanges 12 and 13 to engage a notch 55 in core edge 51 and the core's underside 56, respectively. The carrier is also formed with a number of cavities to engage surface treatment 25 and corner details to be described below.

More specifically, a pair of indentations 57 and 58 in the carrier are provided to engage laterally opposite edges 27 and 28 of casing 25. The forward edge 61 of cavity 57 is tapered relative to the vertical to pull the urethane tightly over the outer surface of carrier 10 as the casing is locked into the cavity by means of a retaining device, such as a PVC extruded insert lock 70, which itself includes an anchor 72 for an interference fit with cavity 74 formed just rearwardly of cavity 57.

The inner surface 20 of casing 25 includes an alignment feature in the nature of, for example, a linear bead 23 that slots into a cavity 68 in the carrier's lower front corner. This provides proper registry between casing 25 and the carrier.

The upper surface 19 of carrier 10 is advantageously formed with a gentle convex curvature to maintain better contact between casing 25 and the carrier.

Finally, the carrier also includes cavities 73 and 75 to provide points of connection and alignment features for corner connectors that will shortly be described in greater detail.

Casing 25 as shown in FIG. 1 is moulded to fit conformably over the carrier and includes a tapered edge 33 to abut the correspondingly tapered surface of notch 55 to ensure precise registration of the casing's edge 36 with edge 52 of core 50.

To connect the nosing system to the core, the nosing system is simply press fit against the core as shown in FIG. 1 and is then held in place by means of, for example, a simple wood screw 86 which passes through flange 13 into the core's underside. This connection maintains a good compressive fit between casing edge 28 and core edge 52.

Figure 3:
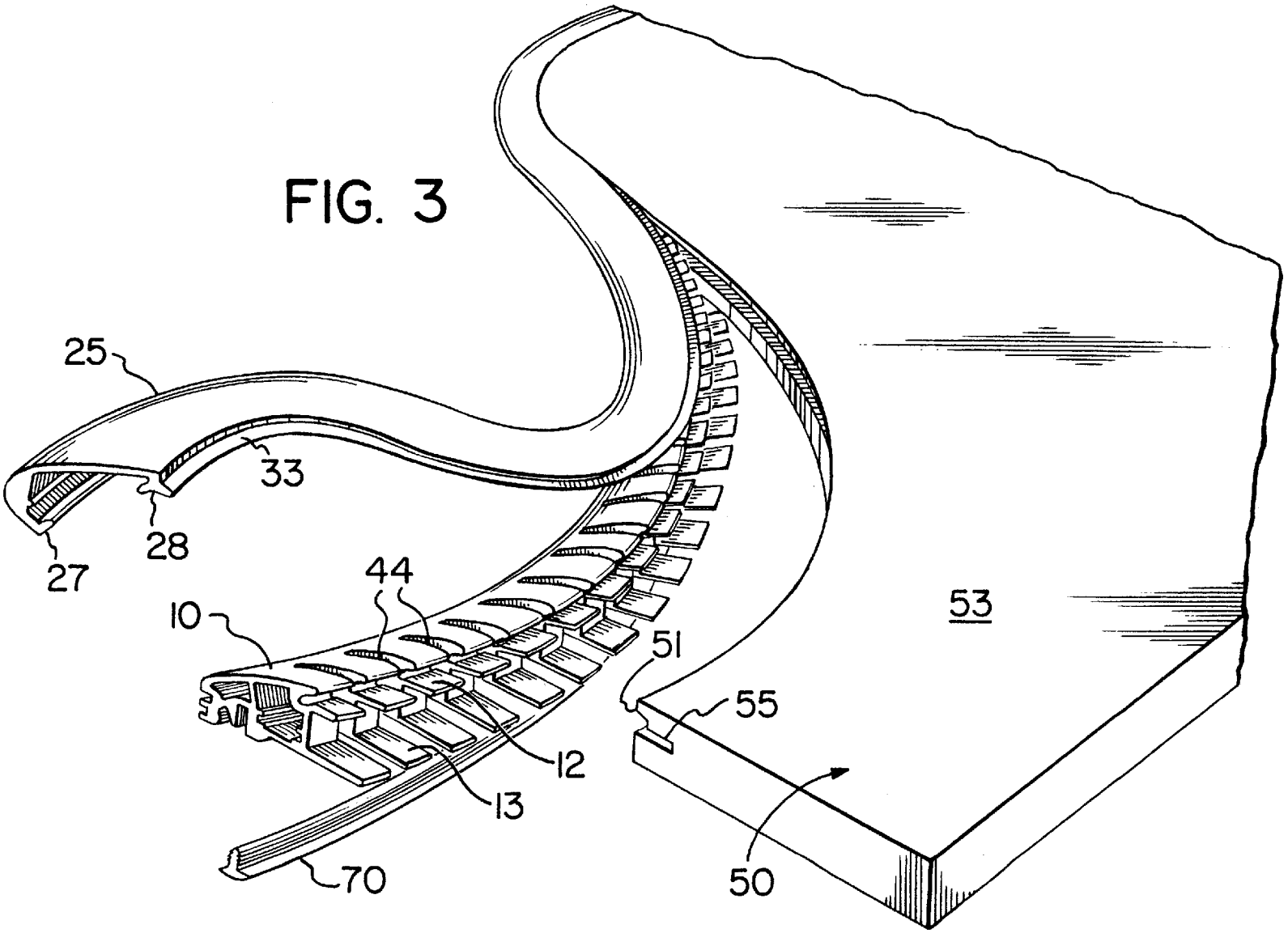
FIG. 3 is a perspective, partially exploded view of the nosing system of FIG. 1 adapted to conform to a curvature.

Carrier 10 is applied in linear lengths for straight line applications. When necessary for the carrier to conform to curved core edges as shown in FIG. 3, a series of partial depth saw cuts 44 extending from the carrier's rear edge to approximately an ⅛ of an inch short of its leading edge allows the carrier to bend and follow the contour of the core. Forming such notches on ⅜ inch centers allows the carrier to conform to tight curves having bending radii as small as 12 inches. For more gradual curves, saw cuts on one inch centers will usually suffice. It has been found in practice that the notches so formed do not telegraph through casing 25 which itself conformably follows the curvature of the carrier and masks any faceting in the carrier's leading edge between the notches along the length of the curvature.

Figure 2:
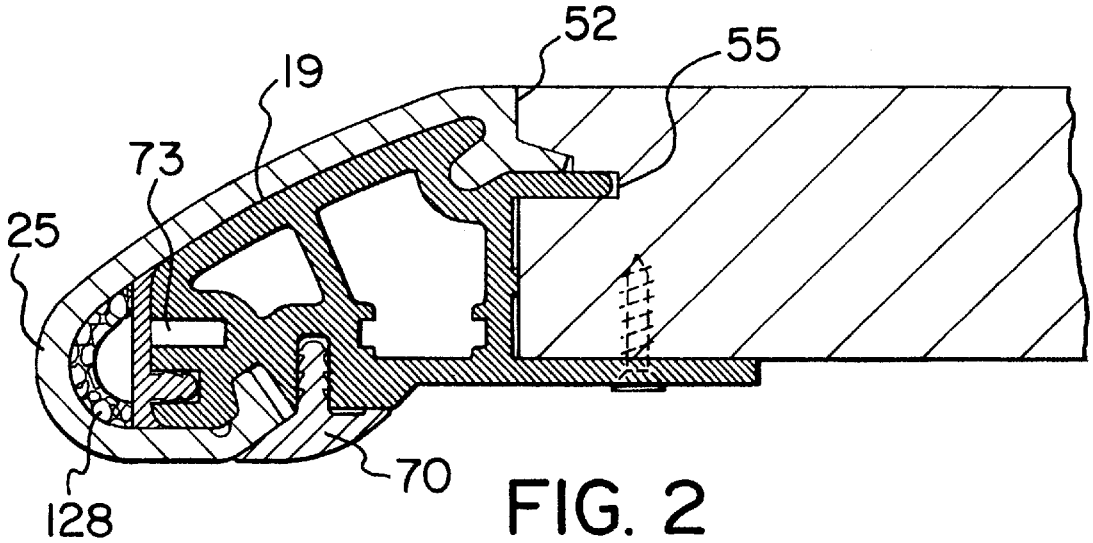
FIG. 2 is a side elevational sectional view of the present nosing system including a nosing insert.
Figure 4:
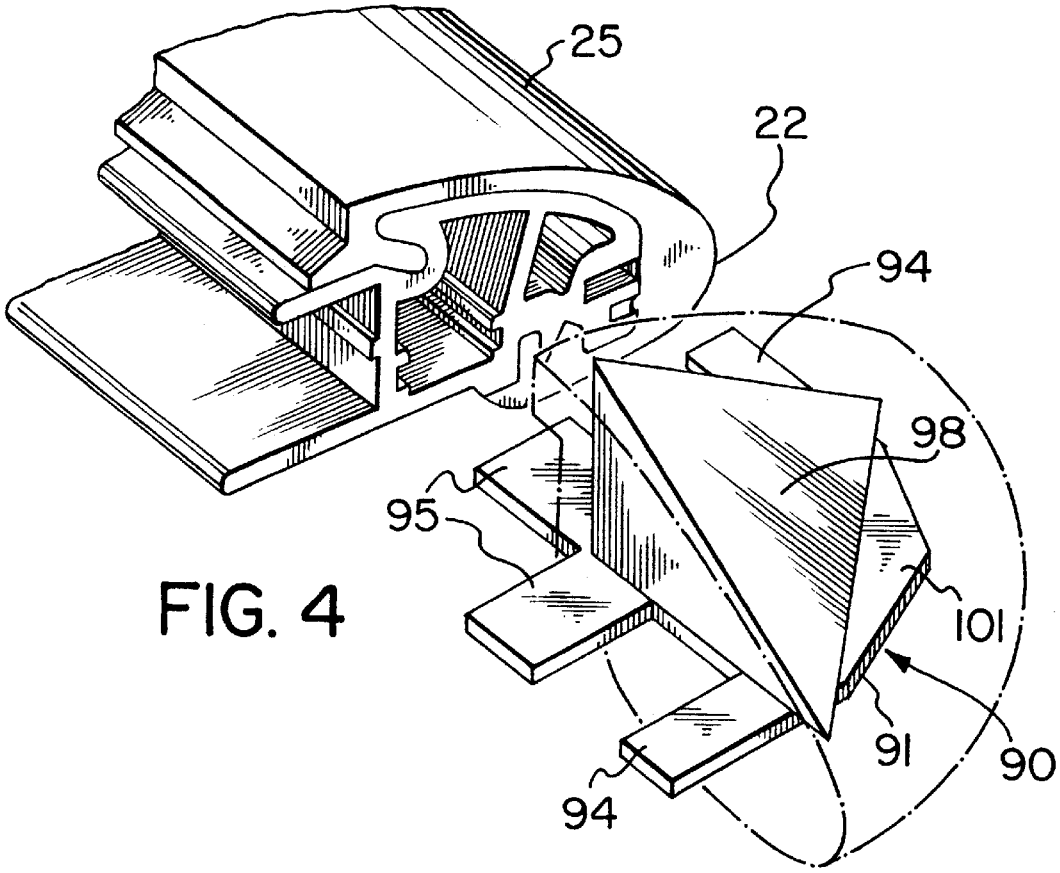
FIG. 4 is a perspective view of an outside corner detail adapted for use in connection with the nosing system of FIGS. 1 and 2.
Figure 5:
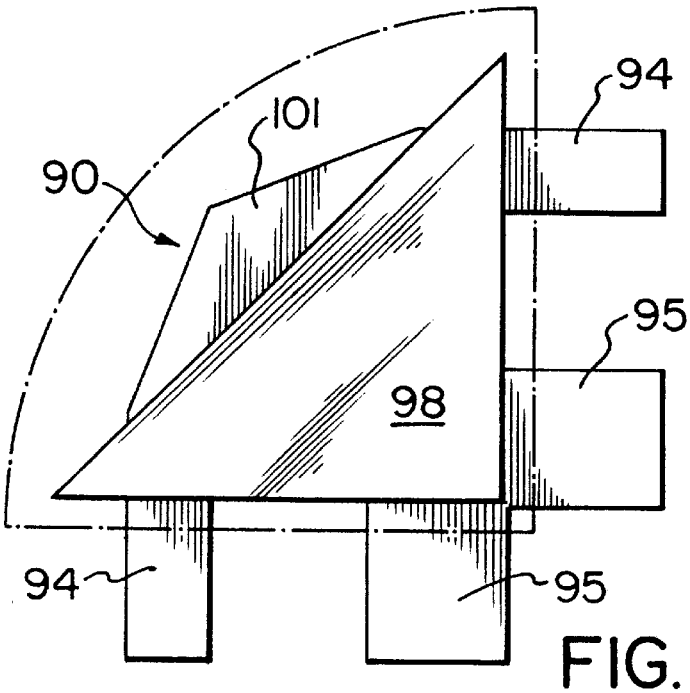
FIG. 5 is a plan view of the detail of FIG. 4.

Moulded casings of the type shown in FIG. 1 tend to be expensive to manufacture and are typically fabricated in 8 foot lengths. Considerably savings will therefore result if the carrier can be extruded in indefinite lengths formed into rolls. Such a casing is shown in FIG. 2. To facilitate its installation over carrier 10, carrier 10 is fitted with a co-extruded nosing insert 128 to provide additional cushioning at the leading edge of the profile.

Where lengths of the present nosing meet at inside corners, it has been found advantageous to simply miter the intersecting pieces. For outside corners, the use of corner connectors is preferred. An exemplary corner connector will now be described with reference to FIGS. 4 and 5.

A corner connector 91 comprises a metal inset 91 including orthogonally extending tabs 94 and 95 adapted for insertion into cavities 73 and 75 in carrier 10.

A triangular insert 98, which may be made of wood, is connected to the upper surface 101 of insert 91. The entire connector, apart from tabs 94 and 95 is then put into a mould and encased in rubber shaped for a conformable fit with the respectively opposed abutting edges 22 of adjacent casings 25.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

I claim:

1. A system for edging a work surface core, comprising:

a work surface core having a work surface and an edge surface extending at least partially about said core;

carrier means having an outer surface of predetermined shape and being adapted for connection to a selected length of said edge surface, said selected length having notch means formed in the longitudinal direction thereof;

surface casing means conformable in shape to said outer surface of said carrier means; and means for connecting said surface casing means to said carrier means so that said surface casing means fit over said outer surface in shape-confirming contact with at least a major portion thereof, said surface casing means including a bead portion adapted for insertion into said notch means in said edge surface.

2. The system of claim 1 wherein said means for connecting comprise laterally opposite edges on said surface casing means extending along the length thereof, said edges being adapted to engage respective cooperatively-shaped spaced apart longitudinally extending first and second indentations in said carrier means.

3. The system of claim 2 wherein one of said edges of said surface casing means includes a first portion to engage said first indentation in said carrier means and said bead portion.

4. The system of claim 3 wherein said bead portion and said notch means each include at least one surface adapted to abut one another upon connection of said carrier means to said edge surface.

5. The system of claim 4 wherein upon connection of said carrier means to said edge surface, a substantially smooth transition is provided between said work surface and said surface casing means.

6. The system of claim 4 wherein said carrier means additionally include a first flange means extending rearwardly from said carrier means, said first flange means being adapted for insertion into said notch means in said edge surface of said core.

7. The system of claim 6 wherein said first flange means, when engaged in said notch means, maintains said at least one surface on each of said bead portion and said notch means in abutment to one another.

8. The system of claim 7 wherein said outer surface of said carrier means includes an upper surface, a nose portion and a lower surface, said surface casing means extending over said upper surface, said nose portion and at least partially over said lower surface.

9. The system of claim 8 wherein said upper surface is convexly curved.

10. The system of claim 8 wherein said second indentation is formed in said lower surface of said carrier means.

11. The system of claim 10 including detachable retainer means connectable to said lower surface of said carrier means to lock said edge of said surface casing means into said second indentation.

12. The system of claim 11 wherein said outer surface of said carrier means include a first cavity formed longitudinally therein, said first cavity means being adapted to receive therein a longitudinally extending bead on said surface casing means to provide registration between said surface casing means and said carrier means.

13. The system of claim 8 including nosing insert means connectable to said nose portion of said carrier means to extend longitudinally there along, said nosing insert means imparting a convex curvature to the cross-sectional profile of said nose portion of said carrier means.

14. The system of claim 6 wherein said carrier means additionally include at least one cut extending there through from a rearmost edge thereof towards said outer surface to facilitate bending of said carrier means to conform to a curvature in said edge surface of said core.

15. The system of claim 14 wherein said carrier means additionally include second and third longitudinally extending cavity means formed therein, said second and third cavity means being adapted to engage connector means where said carrier means meet at outside corners of said core.

16. The system of claim 6 wherein said carrier means additionally include a second rearwardly extending flange means spaced from said first flange means, said second flange means being adapted for engaging another surface of the work surface core for connection thereto.

17. The system of claim 16 wherein said second flange means engages a lower surface of said work surface core, said second flange means being adapted for the insertion of fastener means there through into said work surface core.

18. The system of claim 3 wherein said carrier means are made of aluminum.

19. The system of claim 18 wherein said surface casing means are pliant for padding of said carrier means.

20. The system of claim 19 wherein said surface casing means consist of cast or molded urethane.

21. A nosing system to provide a finished edge to a work surface core, comprising:

a work surface core having a work surface and a peripheral edge extending at least partially about said core, said edge having a longitudinally extending notch formed therein;

carrier means adapted for connection along a predetermined length of said edge of said work surface core; and a layer of padding disposed conformably at least partially about said carrier means, said padding including a longitudinally extending portion projecting rearwardly from said carrier means; wherein, upon connection of said carrier means to said edge, said longitudinally extending portion of said padding is received into said notch formed in said edge so that said padding is held between said carrier and said work surface core for registration with said work surface.

22. The nosing system of claim 21 wherein said carrier means include a first rearwardly extending flange, said first flange being positioned for insertion into said notch together with said longitudinally extending portion of said padding.

23. The nosing system of claim 22 wherein said carrier means include a second rearwardly extending flange spaced laterally apart from said first flange, said second flange being adapted to engage another surface of said core for connection thereto.

24. The nosing system of claim 23 wherein said another surface of said core is a lower surface thereof.

25. The nosing system of claim 24 wherein said first and second flanges provide a load resistant connection of said carrier means to said core.

26. The nosing system of claim 25 including fastener means extending through said second flange into said core.

* * * * *